United States Patent [19]

Paetzold

[11] 4,312,489

[45] Jan. 26, 1982

[54] BAG HOLDER FOR COLLAPSIBLE BAGS

[76] Inventor: William F. Paetzold, 13919 Bay Tree Dr., Sugar Land, Tex. 77478

[21] Appl. No.: 82,770

[22] Filed: Oct. 9, 1979

[51] Int. Cl.[3] ..... A63B 55/04

[52] U.S. Cl. ..... 248/97; 248/99

[58] Field of Search ..... 248/95, 97, 99, 100, 248/101, 156; 141/316, 390; 232/43.1, 43.2

[56] References Cited

U.S. PATENT DOCUMENTS

| | | | |
|---|---|---|---|
| 1,322,445 | 11/1919 | Hyer | 248/97 |
| 1,558,368 | 10/1925 | Jones | 248/97 |
| 3,532,314 | 10/1970 | Vosbikian | 248/97 |
| 3,614,041 | 10/1971 | Koger | 248/97 |
| 3,679,162 | 7/1972 | Burley | 248/156 |
| 3,893,649 | 7/1975 | Cornell | 248/99 |

FOREIGN PATENT DOCUMENTS

| | | | |
|---|---|---|---|
| 834177 | 5/1960 | United Kingdom | 248/156 |

*Primary Examiner*—J. Franklin Foss
*Attorney, Agent, or Firm*—Guy E. Matthews

[57] ABSTRACT

An apparatus for holding collapsible bags is provided comprising a circular ring having an outwardly oriented cross section, whereby a collapsible bag may be inserted into the ring, and the mouth edge of the bag folded out thereover. The bag is then retained in place by an elastic band positioned within a channel defined by the outwardly oriented concave surface of the ring about the bag periphery so as to compress the bag against the peripheral concave surface. The ring is supported in horizontal orientation on a vertical pole either inserted into the ground or positioned within a support stand to maintain the support pole upright.

9 Claims, 4 Drawing Figures

BAG HOLDER FOR COLLAPSIBLE BAGS

BACKGROUND OF THE INVENTION

1. Field of the Invention

This invention relates to an apparatus for supporting a collapsible bag in open position, and more specifically, to a bag holding device incorporating a novel means of attaching the mouth of a collapsible bag to a support ring to retain same in open position, the device being easily disassembled for storing when not in use.

2. Description of the Prior Art

Support devices for holding collapsible bags in open position are not new to this art. Some of the prior art devices incorporate a circular loop having a series of hooks mounted thereon for hooking a bag in various positions about the periphery of the mouth. These hooks have tended to initiate rips and tears at stress points in the collapsible bag, thereby essentially destructing the bag when it is attempted to use the bag as intended, not to mention the time consuming task of attaching this series of hooks to the bag itself. Other devices incorporating a ring to hold the bag utilize clamps positioned about the periphery of the ring and bag to hold the bag in position. Although the clamps themselves did not rip or tear the collapsible bag, the problem of non-uniform support around the bag mouth periphery remained, resulting in potential tears at the stress points of connection of the bag to the ring.

Other bag holding devices incorporated a support pole with a ring mounted thereto that was formed from two essentially flat pieces of flexible material attached to each other to form the circular ring. Due to the required flexibility and inherent low torsional resistance, this type of bag support device lacked sufficient support to maintain a collapsible bag attached thereto upright under moderate loading conditions.

It is therefore an object of the present invention to provide a bag holder for collapsible bags having an improved method of uniformally attaching a collapsible bag to the circular ring thereof.

It is a further object of the present invention to provide a bag holder of simple, yet structurally rigid construction to support increased weight of debris and the like within the bag.

It is a further object of the present invention to provide a bag holding device adaptable for use on a ground surface and on a hard, level surface.

It is a further object of the present invention to provide a bag holding device that is easily disassembled for storing purposes when not in use, and that occupies very little space when stored

SUMMARY OF THE INVENTION

In accordance with the invention, a bag holder for collapsible bags is provided, and comprises a continuous support ring attached to, and supported by, a support pole by means of a "U"-shaped bracket, the bracket having an adjusting means for positioning the support ring relative to the support pole, and holding same in that position. The support ring incorporates an outwardly oriented concave cross section defining a channel therein which receives a resilient or elastic band for uniformally retaining a collapsible bag when the mouth of the bag is positioned around the support ring.

The bag holder of the present invention incorporates a pointed end on the support pole and a foot ledge to enable a person to insert the pole vertically into the ground to maintain the support ring and collapsible bag therein in functional orientation. The device also incorporates a stand into which the support pole may be inserted in order to support the device on a hard level surface for use indoors.

BRIEF DESCRIPTION OF THE DRAWINGS

Other objects and advantages of the invention will become apparent upon reading the following detailed description and upon reference to the following drawings, in which.

Figures 1, 2, 3, 4:
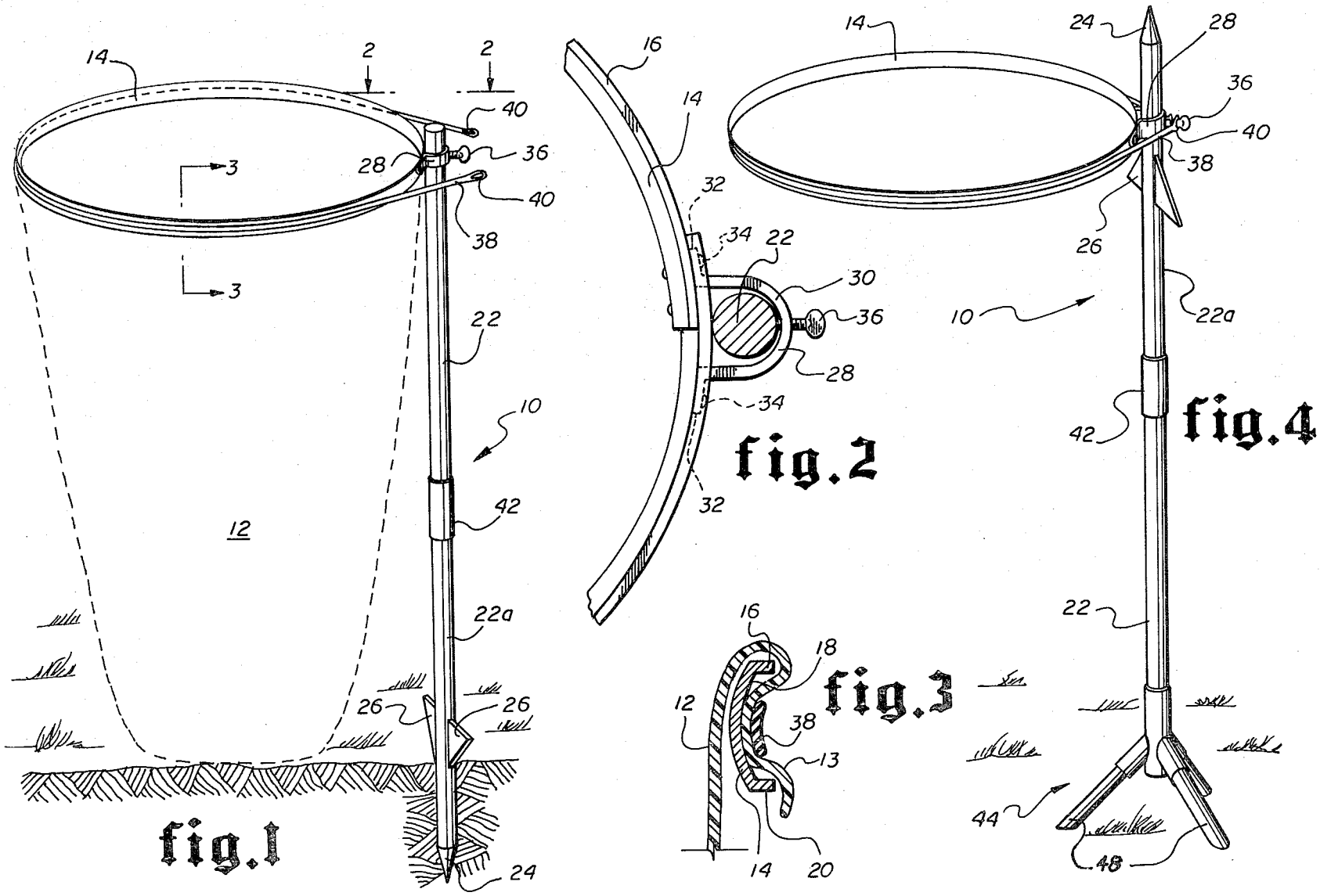
FIG. 1 is a perspective view of the bag holding apparatus of the present invention, showing a collapsible bag in position with hidden lines.
FIG. 2 is a horizontal sectional view taken across lines 2—2 of FIG. 1, showing the means of attaching the support ring to the support pole.
FIG. 3 is a vertical sectional view taken across line 3—3 of FIG. 1, showing the orientation of the bag mouth being retained in place within the concave support ring by the elastic band.
FIG. 4 is a perspective view of the bag holder apparatus of the prsent invention with the support pole inverted and inserted into the stand for use on a hard, horizontal surface.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Turning now to the drawings, the bag holding apparatus of the present invention is shown generally illustrated by the numeral 10. It includes a continuous support ring 14 having a concave cross section defining an annular channel about the periphery thereof. As best shown in FIGS. 1 and 3, an elastic or resilient band 38 is positioned within the concave channel of the support ring 14 to retain the mouth 13 of a collapsible bag 12 in position once the mouth is folded over the outside of the ring 14. The support ring includes a "U"-shaped bracket 28 mounted therewith through which is inserted a support pole 22 in a direction normal to the plane defined by the support ring 14. The "U"-shaped bracket 28 includes means for adjusting the ring 14 relative to the pole 22 and retaining same in position. A preferred embodiment of the present invention incorporates a pointed end 24 to the support pole 22 to enable the pole to be inserted vertically into the ground for positioning the support ring 14 essentially horizontally above the ground at a distance approximating the depth of a collapsible bag 12 attached thereto.

In the preferred embodiment of the present invention, the continuous support ring 14 incorporates a concave cross section opening radially outwardly from the geometric center of the ring. This particular structure (as opposed to a straight or non-curved cross section) imparts an inherent structural rigidity to the support ring 14 to maintain the ring in a basically horizontal position with respect to a vertically oriented support pole 22..

As best shown in FIG. 3, the continuous support ring 14 includes a ring upper edge 16, a concave internal surface 18 and a ring lower edge 20. It can be appreciated from a study of FIG. 3 that the mouth 13 of the collapsible bag 12 should be pulled up on the inner side of the support ring 14 and permitted to fold over the ring upper edge 16 and hang therefrom on the outside of the ring (the right side as shown in FIG. 3). When the elastic band 38 is positioned within the channel defined by the ring upper and lower edges and concave surfaces 16, 20 and 18, as shown in FIG. 3, the band urges the bag mouth 13 into the channel against the concave surface 18 to resist any resulting shear force along the support ring and bag interface as the weight of debris and other material within the bag pulls down on the inside (left side as shown in FIG. 3) of the bag 12. Increased shear force, due to increased material weight within the bag 12, may cause the bag to slip slightly and pivot about the ring, counter clockwise as shown in FIG. 3, tending to move the elastic band 38 upwardly against the ring upper edge 16. As those skilled in the art can appreciate, this serves to further strengthen the shear bond between the support ring 14 and bag mouth 13 as the elastic band 38 is urged upwardly along the concave surface 18 against its natural tendency to position itself within the innermost portion of the concave channel, thereby further resisting any force tending to dislodge the bag mouth 13 from the support ring 14.

In accordance with a further aspect of the invention, it can be appreciated that the resultant radially inward force provided by the elastic band 38 acts continuously along essentially the entire periphery of the bag mouth 13 and support ring 14 to provide a uniform distribution of shear force to retain the bag in position.

As best shown in FIG. 2, the support ring 14 is adjustably mounted to the support pole 22 by the "U"-shaped bracket 28. The "U" bracket includes a "U" section 30, its respective ends terminating in essentially flat sections 32 which are attached to the support ring 14 at 34 in any suitable manner such as welding, brading or bolting, to provide a structurally rigid interface between the support ring and "U" bracket. As shown, the support pole 22 extends through the "U" section 30 and is adjusted laterally thereon depending on the depth of collapsible bag 12 to be used. An adjusting screw 36 is threadedly inserted into the "U" bracket 28 to engage the support pole 22 to retain the support ring 14 in position thereon.

As best shown in FIG. 1, the support pole 22 includes a pointed end 24 to facilitate easy insertion of the pole into the ground. The preferred embodiment also includes at least one laterally extending ledge 26 in close proximity with the pointed end 24 to enable a person to step on the ledge with his foot to aid in inserting the support pole into the ground.

In operation, the user first positions the support pole 22 vertically upon the ground and, using his foot to press down upon a pole laterally extending edge 26, inserts the pole in a vertically upright position. He next attaches the support ring 14 to the support pole 22 by inserting the upper end of the pole through the "U" bracket 28 and adjusts the height of the ring relative to the ground approximately 4–6 inches less than the length of the particular collapsible bag to be used. After manually tightening the adjusting screw 36, the user positions a collapsible bag within the support ring 14 and opens the mouth 13 of the bag. He next wraps the bag mouth 13 around the support ring, permitting the mouth to extend downwardly from the ring upper edge 16 approximately 4 inches along essentially the entire periphery of the support ring 14. Obviously, the pole 22 being positioned as shown in the drawings, will interfere with the bag mouth 13 hanging uniformally about the periphery of the support ring 14; however, the net effect of this is negligible, and the bag mouth 13 must necessarily pass over the "U" bracket between the support ring and the pole.

With the bag 12 and bag mouth 13 so positioned, the user retains same in position by the use of the elastic band 28. As best shown in FIG. 1, the band 38 has a loop 40 on each end thereof by which the band is removably affixed to the support ring 14. The user hooks one of the loops 40 onto the adjusting screw 36 and wraps the elastic band 38 around the support ring 14 within the channel defined therein and against the exposed 4 inch lip of the bag mouth 13, urging the lip against the support ring concave surface 18 (as shown in FIG. 3), uniformally around the periphery of the support ring. He next hooks the second band loop 40 around the adjusting screw to retain the band within the channel, once so positioned.

As described hereinabove, with the elastic band 38 so positioned, the collapsible bag 12 may be filled with grass, leaves, or other suitable debris, with the weight of such debris causing the elastic band 38 to more snuggly grasp the bag mouth 13 and retain same in place against the support ring concave surface 18 and upper edge 16.

When the collapsible bag 12 is suitably filled, the user simply reverses his procedure used in attaching the bag to the support ring 14; specifically, he removes an elastic band looped end 40 from the adjust screw 36, permitting the loose end of the band to fall to the ground, while holding the bag full of debris by the mouth thereof with his free hand. He next completes the removal of the bag mouth 13 from the support ring 14 and suitably ties the mouth thereof closed. The bag 12 may now be dragged or carried away for proper disposal.

At this point, the user may install a second collapsible bag 12 by the procedure outlined above, or he may desire to relocate the bag holder 10 before installing a second collapsible bag. To relocate the bag holder 10, the user simply grasps the support pole 22 and removes it from the ground. He next relocates the bag holder 10, and following the procedure outlined above for inserting the support pole 26 into the ground, inserts now, the assembled bag holder 10 into the ground, and installs a second collapsible bag following the procedure outlined hereinabove.

FIG. 4 illustrates a second embodiment of the present invention, that being the bag holder 10 of the present invention used with a stand 44 to enable the bag holder 10 to rest upright upon a level, hard surface, as in a garage or patio. The stand 44 includes a cylindrical section 46 for receiving an end of the support pole 22 and three feet, 48 extending radially therefrom at approximately 45° from horizontal, and spaced apart by approximately 120°. As shown in FIG. 4, the support pole 22 is inverted in this alternative embodiment, so that the flat or blunt end of the pole is inserted into the stand cylindrical section 46, the support ring being affixed to the upper end of the pole, as in the preferred embodiment, and the height thereof adjusted as described hereinabove.

The bag holder 10 of the present invention is readily disassembled by simply loosening the adjusting screw 36, removing the support ring 14 from the support pole 22 and either rmoving the support pole from the ground or from its stand 44 as shown in FIG. 4. The apparatus is adapted to be stored conveniently in a garage or closet and occupy very little space. The support ring 14 may be suspended from a peg or nail driven into a garage wall or the like; the stand 44 may likewise may be positioned on a wall up out of the way; and the support pole 22 may simply be stored in a corner of two adjacent walls or a wall and the floor.

To further simplify the storing of the support pole 22, the pole may comprise two separate pieces 22 and 22*a* connected together by an intermediate connection 42 comprising a sleeve or swageformed section concentric with the support pole 22 so that the two sections may be axially aligned and connected in typical fashion to form the support pole used in the present invention, and may be readily disassembled for compact storing when not in use.

Thus it is apparent that there has been provided, in accordance with the invention, a bag support device that fully satisfies the objects, aims, and advantages as set forth above. While the invention has been described in conjunction with specific embodiments, it is evident that many alternatives, modifications, and variations will be apparent to those skilled in the art in light of the foregoing description. Accordingly, it is intended to embrace all such alternatives, modifications, and variations as fall within the spirit and scope of the appended claims.

The invention having been described, what is claimed is:

1. A bag holder for supporting collapsible bag, comprising:

(a) a continuous support ring for supporting said collapsible bag when said bag is inserted into said support ring and the bag mouth is folded over said support ring and retained thereby, said support ring including an outer surface having upper and lower ends and an upper ring edge extending outwardly from said upper end; in the plane defined by said support ring to form a corner between said outer surface and said upper ring edge;

(b) a support pole for supporting said ring, said pole having a pointed end to facilitate easy insertion into the ground;

(c) a bracket attached to said ring, said support pole extending therethrough to support said ring in an orientation normal to said pole; and (d) a resilient band adapted to be positioned about said support ring to retain said folded over collapsible bag mouth against said outer surface below said upper ring edge in position about said ring.

2. The bag holder as set forth in claim 1, including bracket adjusting means comprising an adjusting screw threadedly inserted into said bracket to engage said support pole to retain said ring in position about said pole.

3. The bag holder as set forth in claim 2, wherein said resilient band includes a closed loop on each end thereof for wrapping around said adjusting screw to retain said band in position about said support ring.

4. The bag holder as set forth in claim 3, wherein said support pole comprises two sections, whereby said pole may be disassembled to facilitate convenient storing of said bag holder when not in use.

5. The bag holder as set forth in claim 4, wherein said support pole includes a laterally extending ledge adjacent said pointed end to enable a person to step thereon to aid in inserting said support pole into the ground.

6. The bag holder as set forth in claim 1, 2, 3, 4, or 5, further comprising a stand for receiving said support pole in a vertical orientation, thereby enabling said bag holder to sit upright on a hard, horizontal surface.

7. The bag holder as set forth in claim 1, including a lower ring edge extending outwardly from said lower end.

8. The bag holder as set forth in claim 1, wherein said outer surface has an outwardly concave cross section between said upper and lower ends.

9. A bag holder for supporting collapsible bag, comprising:

(a) a continuous support ring for supporting said collapsible bag when said bag is inserted into said support ring and the bag mouth is folded over said support ring and retained thereby, said support ring including an outer surface having upper and lower ends and an upper ring edge extending outwardly from said upper end;

(b) a support pole for supporting said ring, said pole having a pointed end to facilitate easy insertion into the ground, wherein said support pole comprises two sections, whereby said pole may be disassembled to facilitate convenient storing of said bag holder when not in use;

(c) a bracket attached to said ring, said support pole extending therethrough to support said ring in an orientation normal to said pole, including bracket adjusting means comprising an adjusting screw threadedly inserted into said bracket to engage said support pole to retain said ring in position about said pole;

(d) a resilient band adapted to be positioned about said support ring to retain said folded over callapsible bag mouth against said outer surface below said upper ring edge in position about said ring, said resilient band including a closed loop on each end thereof for wrapping around said ajusting screw to retain said band in position about said support ring;

(e) and a stand for receiving said support pole in a vertical orientation, thereby enabling said bag holder to sit upright on a hard, horizontal surface.

* * * * *